US009909485B2

(12) United States Patent
Hong

(10) Patent No.: US 9,909,485 B2
(45) Date of Patent: Mar. 6, 2018

(54) COOLING FAN MODULE AND SYSTEM

(71) Applicant: Brose Fahrzeugteile GmbH & Co. Kommanditgesellschaft, Wuerzburg, Wuerzburg (DE)

(72) Inventor: Tao Hong, Farmington Hills, MI (US)

(73) Assignee: Brose Fahrzeugteile GmbH & Co. Kommanditgesellschaft, Würzburg, Würzburg (DE)

( * ) Notice: Subject to any disclaimer, the term of this patent is extended or adjusted under 35 U.S.C. 154(b) by 339 days.

(21) Appl. No.: 14/689,162

(22) Filed: Apr. 17, 2015

(65) Prior Publication Data

US 2016/0305448 A1 Oct. 20, 2016

(51) Int. Cl.

| | |
|---|---|
| ***F01P 5/02*** | (2006.01) |
| ***F01P 1/06*** | (2006.01) |
| ***F04D 29/16*** | (2006.01) |
| ***F04D 29/32*** | (2006.01) |
| ***F01P 5/06*** | (2006.01) |
| ***F01P 11/12*** | (2006.01) |
| *F01P 11/10* | (2006.01) |

(52) U.S. Cl.

CPC *F01P 5/02* (2013.01); *F01P 1/06* (2013.01); *F01P 5/06* (2013.01); *F01P 11/12* (2013.01); *F04D 29/164* (2013.01); *F04D 29/326* (2013.01); *F01P 11/10* (2013.01)

(58) Field of Classification Search

CPC ... F01P 5/02; F01P 1/06; F04D 29/164; F04D 29/326; F04D 29/4253; F04D 29/526

USPC ..... 416/169 A, 189

See application file for complete search history.

(56) References Cited

U.S. PATENT DOCUMENTS 5,489,186 A * 2/1996 Yapp ..... F01D 5/141 415/208.3

7,114,921 B2 * 10/2006 Iwasaki ..... F04D 29/326 415/173.6

* cited by examiner

*Primary Examiner* — Justin Seabe

*Assistant Examiner* — Juan G Flores

(74) *Attorney, Agent, or Firm* — Westman, Champlin & Koehler, P.A.

(57) ABSTRACT

A cooling fan module includes a frame, and a fan impeller having a plurality of fan impeller blades is located in an opening of the frame. The fan impeller blades are connected to a base portion of an outer fan ring. A lip portion of the outer fan ring extends from the base portion radially outward, and a leading end of the lip portion is turned in direction to the downstream side of the frame. A recirculating flow guiding device includes a plurality of guide vanes located on an upstream side of the frame and around the opening of the frame. An air gap is provided between the outer fan ring and the frame. A recirculating flow travels from downstream side of the cooling fan module through the air gap, and is turned by the leading end of the lip portion into the recirculating flow guiding device.

17 Claims, 11 Drawing Sheets

COOLING FAN MODULE AND SYSTEM

FIELD OF THE INVENTION

The present invention relates to a cooling fan module, in particular in the automotive field, e.g., for a motor vehicle, and a system comprising a cooling fan module and a radiator and/or condenser.

TECHNICAL BACKGROUND

Cooling fan modules are used to cool the engine in motor vehicles. In this connection, it is the aim to improve the cooling performance for the engine, transmission and the comfort of the vehicle occupants, especially with regard to increasing fan efficiency and minimising the noise generated by the cooling fan module.

Generally a cooling fan module consists of a fan impeller, a motor located at the centre of the fan to drive the fan impeller, and a frame or shroud which comprises assembly struts for fixing the motor. Further, the fan impeller of a cooling fan module is designed to produce an air flow with which the heat generated by the engine is removed.

In an engine cooling fan module, pressure downstream of or after the fan is higher than pressure upstream of or in front of the fan for the effective fan operating range. This pressure difference drives airflow from downstream of the fan back to upstream of it forming undesired recirculating flow through the running clearance between the frame orifice or shroud orifice and the fan ring of the fan impeller. Due to the rotation of the fan, there is a swirling motion in downstream of the fan, this swirling motion is carried to front of the fan by this recirculating flow, friction force from the rotating fan ring also contributes to this swirling motion in the recirculating flow. This recirculating flow then is drawn back into the fan again in fan blade tip region. As a result, in the tip region of the fan blade there is a large variation of tangential airflow velocity, and the blade is at varying angles of attack different from that of the main flow, which leads to airflow separation in blade tip region, this portion of blade becomes low in efficiency, noisy and inconsistent with the rest of the fan blade. At the largest radius, the tip region of the fan blade has the largest working potential and biggest influence on the performance of the entire fan. This reduced performance at the blade tip region decreases efficiency of the fan module significantly.

SUMMARY OF THE INVENTION

Against this background, an objective of the present invention is to provide an improved cooling fan module for a motor vehicle.

This objective is achieved according to the invention by a cooling fan module having the features in claim 1.

A cooling fan module, in particular for a motor vehicle, comprising:

a frame, wherein the frame is provided with an opening;

a fan impeller located in the opening of the frame, wherein the fan impeller comprises a plurality of fan impeller blades, wherein the fan impeller blades are connected to one another at an outer end via an outer fan ring, wherein the fan ring comprises a base portion and a lip portion, wherein the fan impeller blades are connected to the base portion, wherein the lip portion extends from the base portion radially outward and wherein a leading end of the lip portion is turned in direction to the downstream side of the frame;

a recirculating flow guiding device located on the upstream side of the frame and around the opening of the frame, wherein an air gap is provided between the fan ring and the frame, a recirculating flow from downstream side of the cooling fan module flowing through said air gap, and is turned by the leading end of the lip portion into the recirculating flow guiding device to remove swirl motion from the recirculating flow.

The concept underlying the invention entails guiding airflow, so that the airflow flowing through the air gap can go straight outwards radially into the recirculating flow guiding device without been severely blocked or forced to turn axial immediately. Since the recirculating airflow can be effectively directed into the recirculating airflow guiding device instead of bypassing it swirl motion from the airflow can be removed by the recirculating flow guiding device. As a result performance of the tip region of the fan blades is improved which leads to a more efficient fan module and lower noise.

Advantageous embodiments and developments of the invention emerge from the additional subordinate claims and from the description with reference to the drawing figures.

According to an embodiment of the invention at least a downstream side of the lip section is turned in direction to the downstream side of the frame, wherein an upstream side of the lip section is also turned in direction to the downstream side of the frame or extends at least partially straight to the base section of the fan ring. This lip design force reverse airflow going radially outwards with velocity component toward downstream of the fan to more effectively directing airflow into guiding vanes and prevent airflow bypassing them. In an embodiment of the invention the leading end of the lip section is curved or folded to turn the leading end in direction to the downstream side of the frame, wherein the leading end is folded forming a sharp folding edge as shown below in FIG. 6 or a rounded folding edge as shown by the dotted line below in FIG. 6.

In a further embodiment of the invention at least one of a leading edge or a trailing edge of the leading end is rounded or forms a sharp edge as shown below in FIGS. 5 and 7. A sharp edge is a little more effective in directing airflow direction, and a rounded edge has a slightly lower noise.

According to an embodiment of the invention the recirculating flow guiding device is located between the frame and the fan impeller on the upstream side of the frame. Since the swirl motion is removed by the recirculating flow guiding device, the airflow goes back into the fan impeller again with the same tangential relative velocity to the fan impeller as the normal incoming airflow. Thus, fan efficiency is enhanced.

In an embodiment of the invention, the recirculating flow guiding device comprises guide vanes which are arranged around the opening of the frame and the circumference of the fan impeller, wherein the guide vanes are oriented preferably in the radial direction of the fan impeller. Thus, the airflow flowing through the air gap can go straight outwards radially and can be further directed into the guide vanes to remove swirl motion.

In a further embodiment of the invention, at least two of the guide vanes comprise the same length or are different in length. Guide vanes of different length can be provided in case of geometry limitation as shown in FIGS. 22 and 25, or in case the distance between two long guide vanes is too small to fit in an additional long guide vane in between in the molding tooling as shown below in FIG. 20. Further, when radius increases, distance between guide vanes also increases and a partial guide vane or shorter guide can be fit in between the two longer or long guide vanes. Moreover, the more guiding vanes the better, as airflow will be less likely to separate and better follows curvature of the vanes.

In another embodiment of the invention at least two of the guide vanes comprise at least one curved portion and/or at least one straight portion. The leading edge of the curved portion of the guide vanes is aligned with incoming recirculating airflow direction. The curved guide vanes remove swirl motion by gradually change the direction of the recirculating airflow to reduce airflow separation, airflow loss and noise. When design is right, curved or a portion is curved guiding vanes will align its leading edge with incoming reverse airflow, so there is no separation, and guiding vanes is more effective and fan module is more efficient with less noise.

According to an embodiment of the invention at least two of the guide vanes extend to an outer edge of the frame or terminate at the outer edge of the frame as shown below in FIG. 25. Such guiding vanes can remove even more swirl motion as reverse flow stay longer within these vanes.

In an embodiment of the invention at least an outer portion of the guide vanes comprises a height, so that the outer portion of the guide vane extends beyond the upstream side of the fan ring, terminates at the upstream side of the fan ring or terminates before the lip section of the fan ring. Guide vanes which extend beyond the upstream side of the fan ring reduce airflow bypassing these guide vanes.

In a further embodiment of the invention the guide vanes are equally and/or unequally spaced around the circumference of the fan impeller. An angular spacing between two neighbouring guide vanes is for example in a range between 1° degree to 5° degrees. Tonal noise can be minimized when guide vanes are unequally spaced.

According to the preferred embodiment of the invention the clearance between the guide vanes and the fan ring is as tight as possible to reduce overall recirculating flow rate and reduce airflow bypassing these guide vanes. For a 400 mm to 500 mm diameter fan impeller the clearance is, e.g., in a range between 4 mm to 6 mm in radial direction and in a range between 5 mm to 7 mm in axial direction of the fan impeller.

In the preferred embodiment of the invention the frame is configured so that an airflow passing through an exit of an airflow passage formed by the air gap can go straight or essentially straight outwards radially without been blocked by a wall of the frame as shown below in FIG. 9. Thus, airflow flowing through the air gap and going straight outwards radially is not blocked and can be directed to the guide vanes to remove swirl motion.

In another embodiment of the invention the thickness of at least one guide vane is in a range of, e.g., 1 mm to 3 mm.

According to a further embodiment of the invention a system comprising a cooling fan module and further a heat exchanger. The heat exchanger can be arranged on the upstream side and/or the downstream side of the fan module dependent on the intended function or use.

CONTENT OF THE DRAWINGS

The present invention is explained below in greater detail with the aid of embodiments specified in the schematic figures in the drawings. These are as follows.

Figure 9A:
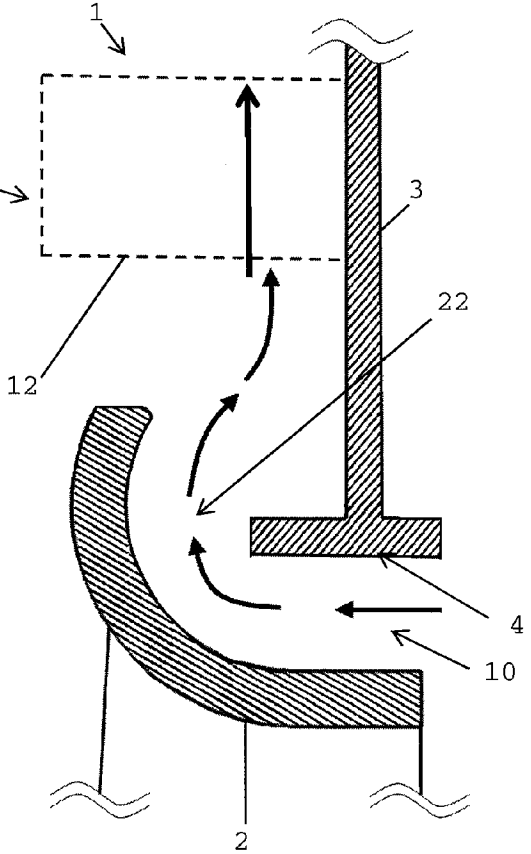
Figure 9B:
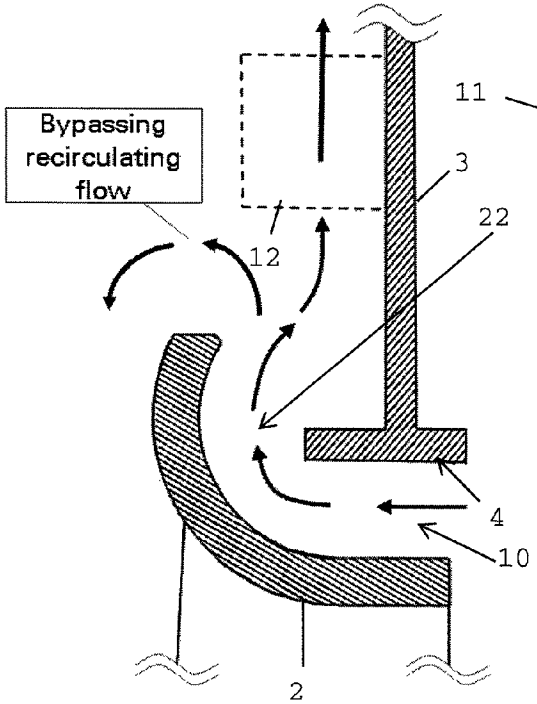
Figure 12:
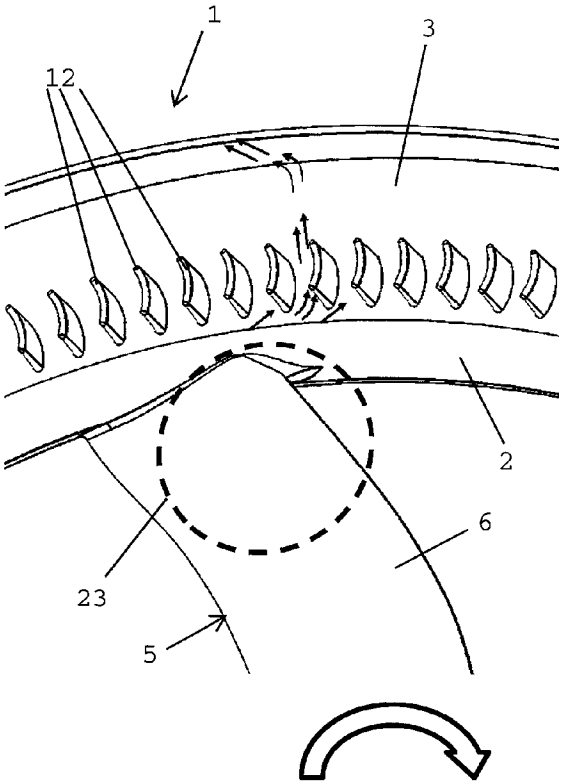
Figure 11:
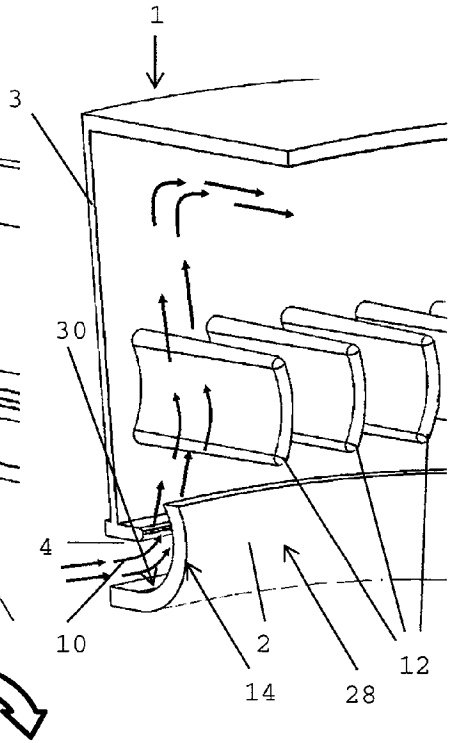
Figure 10:
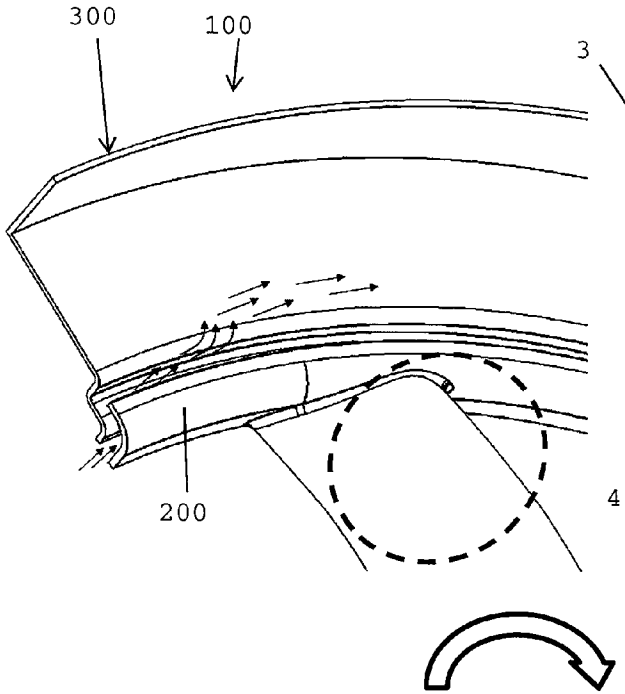
Figure 14:
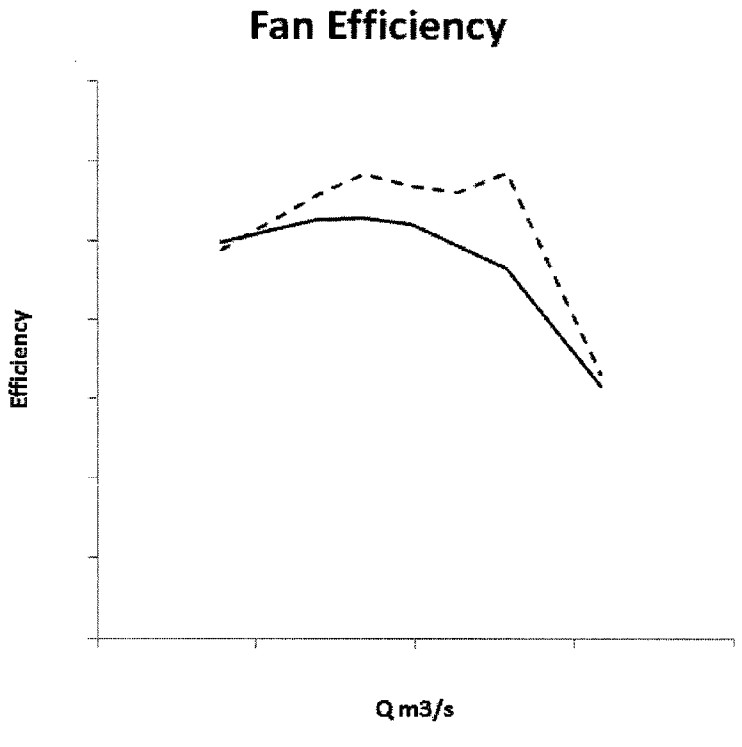
Figure 13:
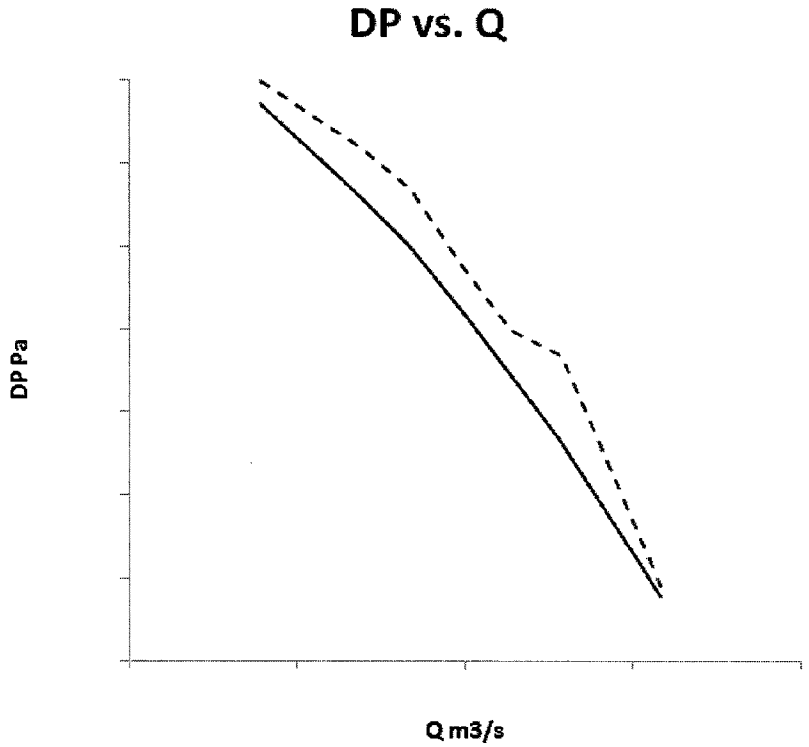
Figure 16:
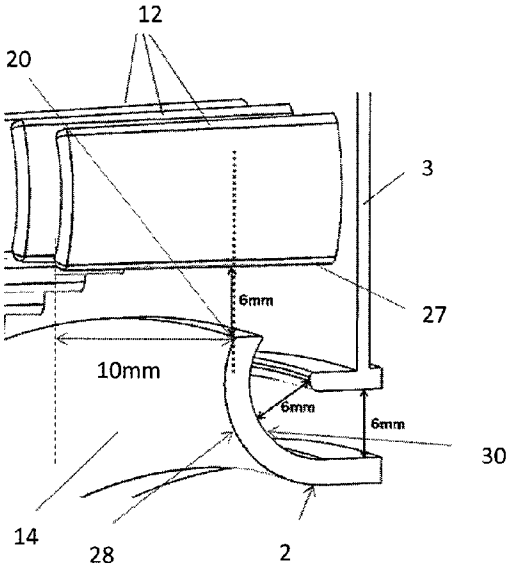
Figure 16:
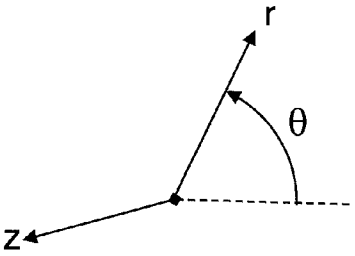
Figure 15:
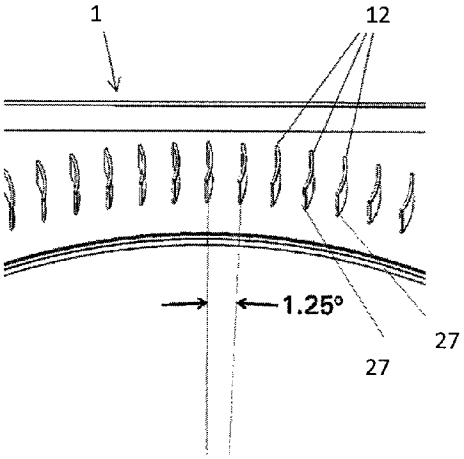
Figure 15:
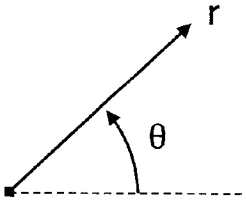
Figure 19:
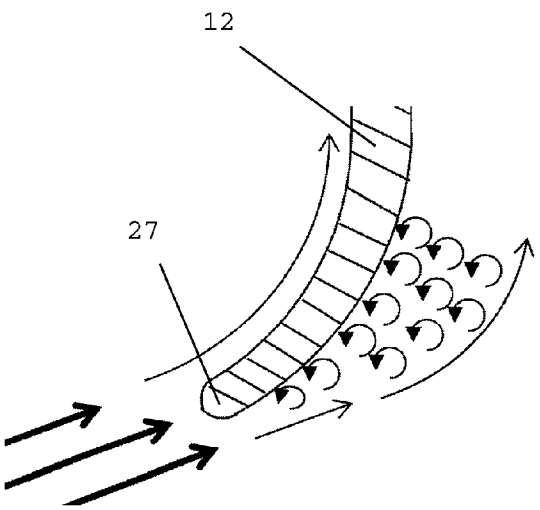
Figure 18:
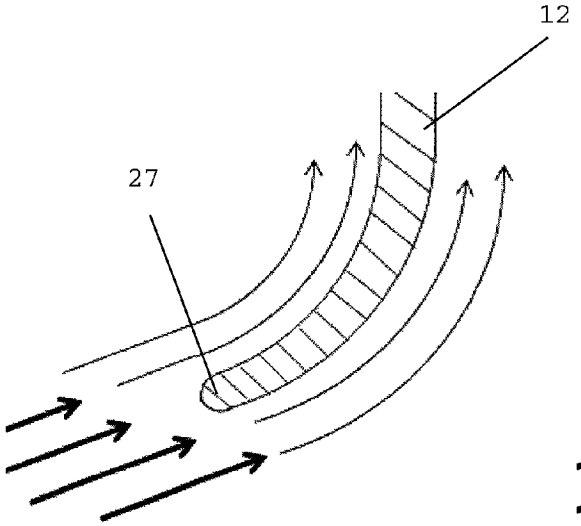
Figure 17:
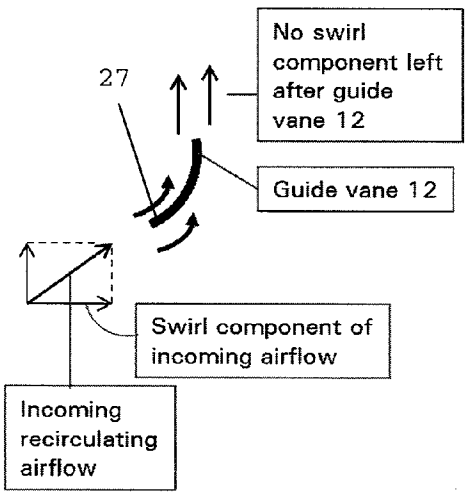
Figure 21:
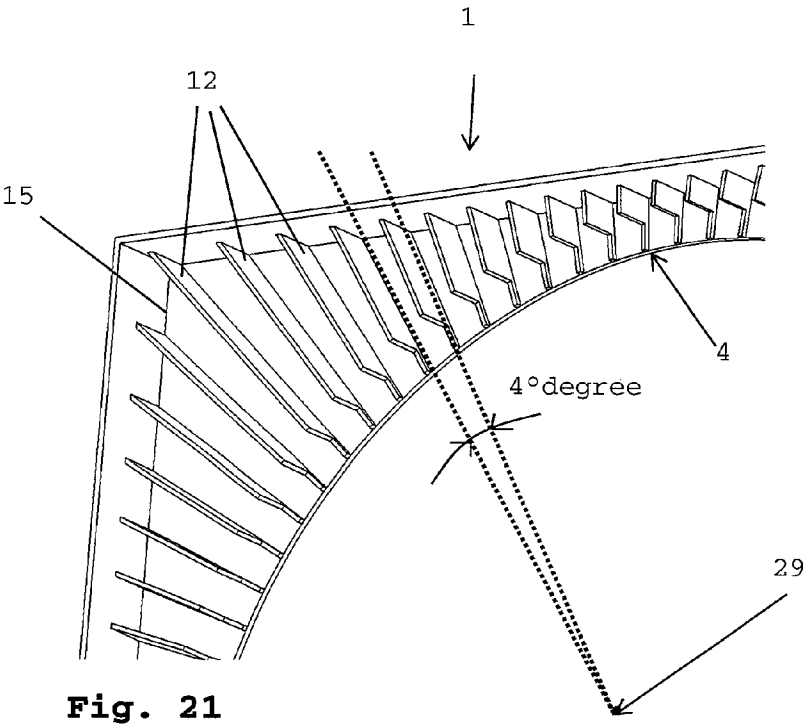
Figure 20:
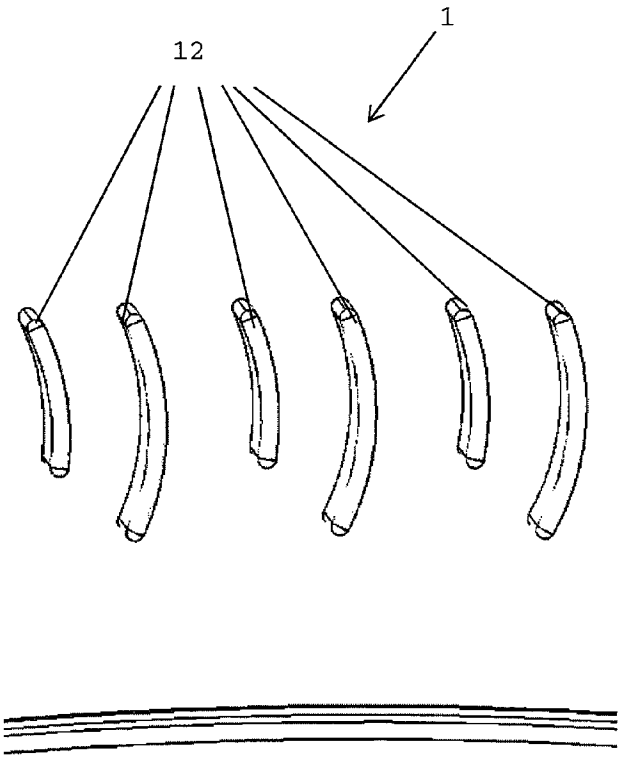
Figure 24:
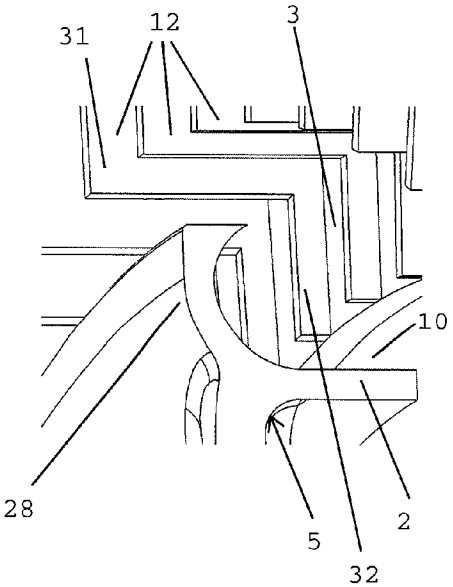
Figure 23:
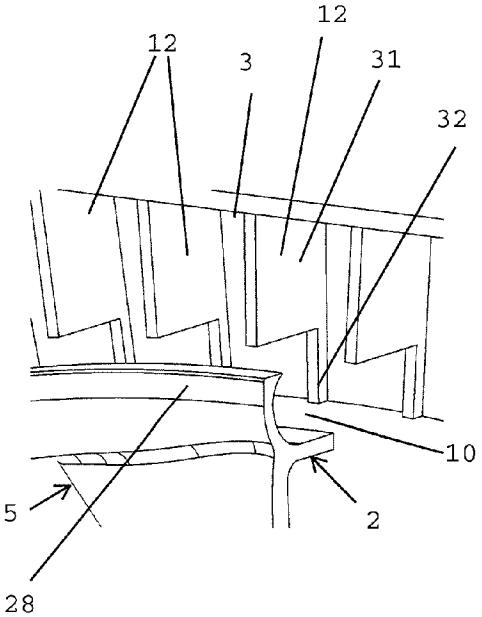
Figure 22:
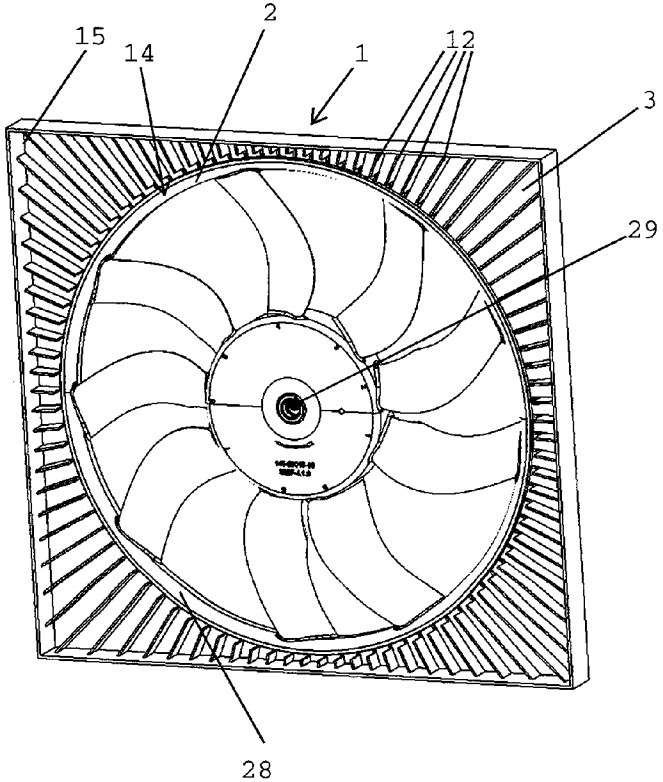
Figure 26A:
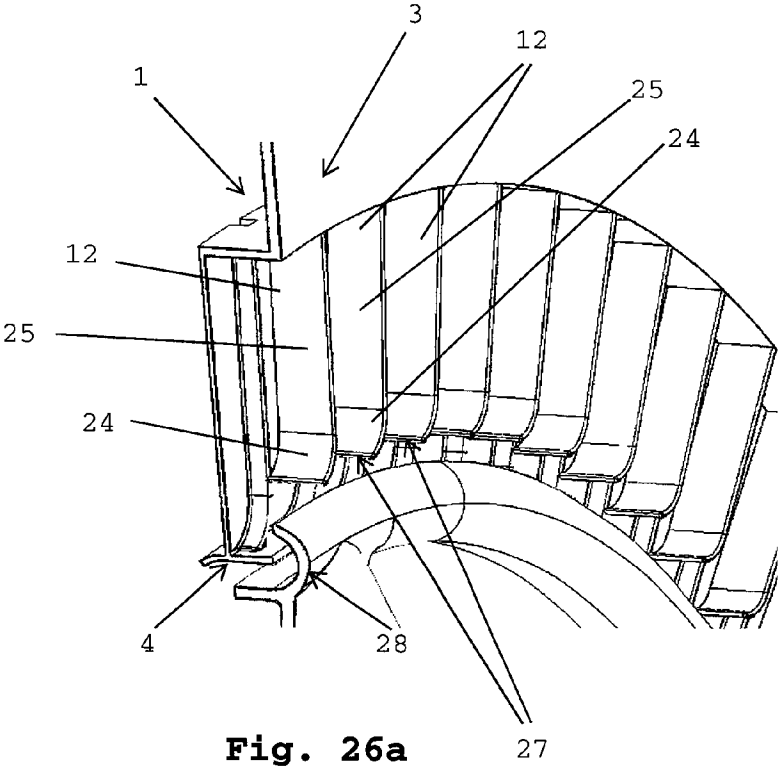
Figure 25:
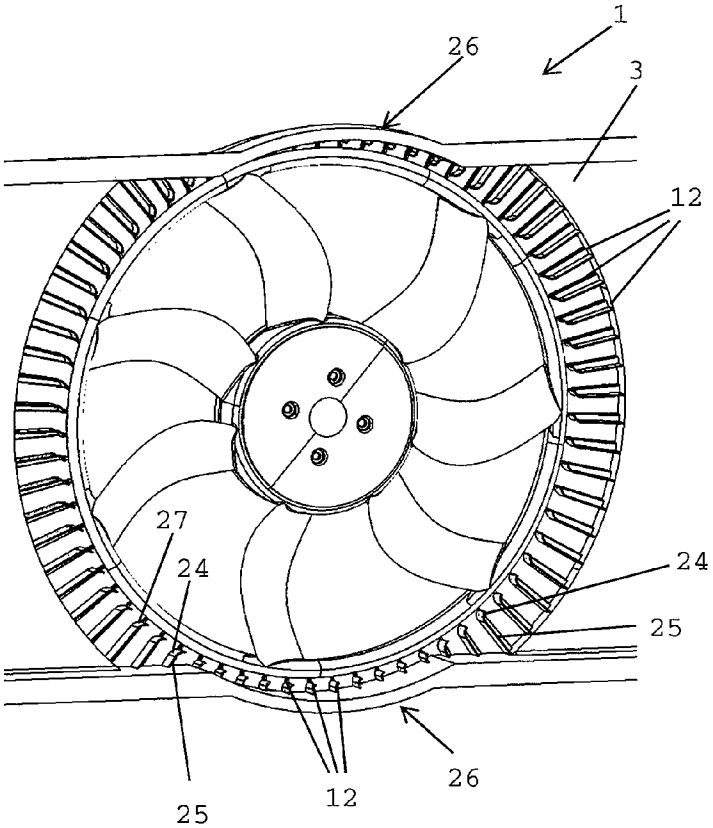
Figure 26B:
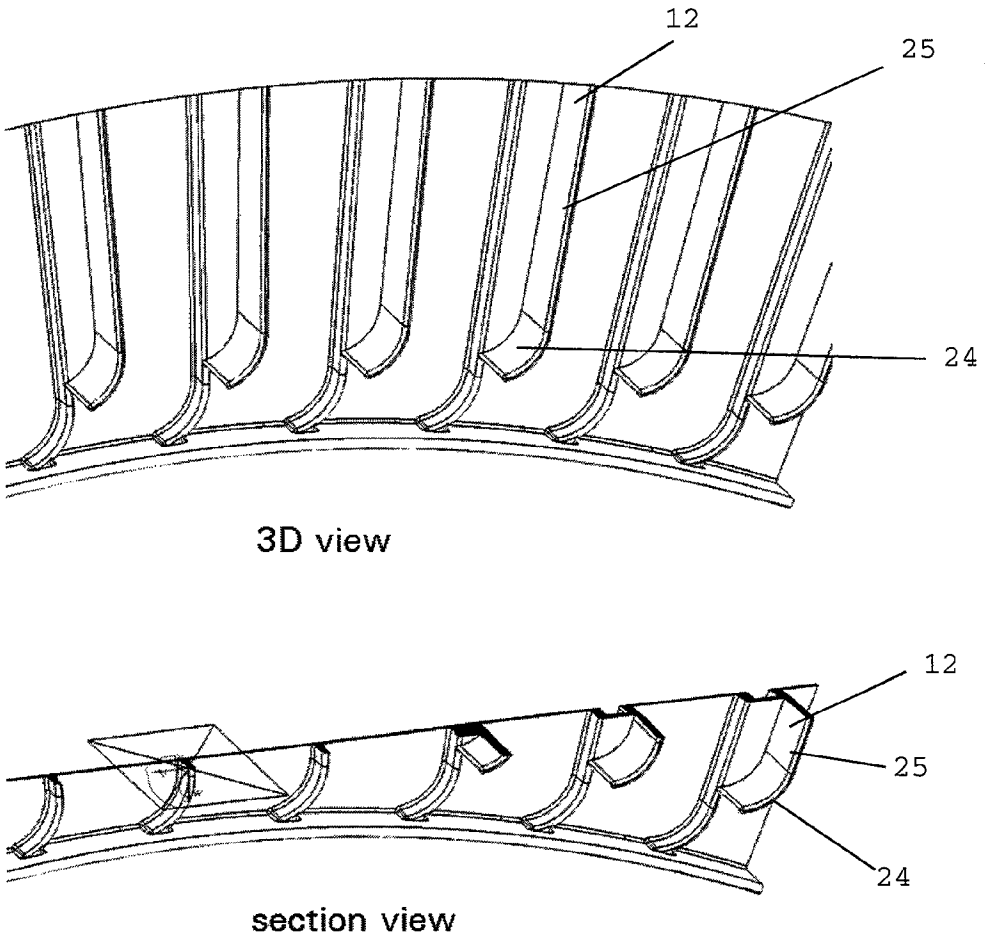

FIG. 9*a* shows a cross-section of a section of the fan module according to the first embodiment of the invention;

FIG. 9*b* shows a cross-section of the fan module of FIG. 9*a*, wherein the guide vane is too short;

FIG. 10 shows a perspective view of a section of a conventional fan module;

FIG. 11 shows a perspective view of a section of the fan module according to the first embodiment of the invention;

FIG. 12 shows another perspective view of a section of the fan module according to the first embodiment of the invention;

FIG. 13 shows a diagram, illustrating a fan pressure rise versus flow rate curve of a conventional cooling fan module and that of the first embodiment of the invention; in both case the fan blades are the same, only fan ring to frame interface configuration is different;

FIG. 14 shows a diagram, illustrating a fan efficiency versus flow rate curve of the conventional cooling fan module and that of the first embodiment of the invention; in both case the fan blades are the same, only fan ring to frame interface configuration is different;

FIG. 15 shows a perspective view of a section of the fan module according to an embodiment of the invention;

FIG. 16 shows a cross-section of the fan module of FIG. 15 in a perspective view;

FIG. 17 shows a schematic view of a guide vane according to the invention, wherein the leading edge of each guide vane is aligned with the incoming recirculating airflow;

FIG. 18 shows a further schematic view of a guide vane according to the invention;

FIG. 19 shows a schematic view of a guide vane, wherein the leading edge of the guide vanes is not aligned with the incoming recirculating airflow;

FIG. 20 shows a perspective view of a section of an alternative of the fan module according to FIG. 15;

FIG. 21 shows a perspective view of a section of a fan module according to a further embodiment of the invention;

FIG. 22 shows a further perspective view of the fan module of FIG. 21, including the fan impeller and the fan ring;

FIG. 23 shows a cross-section of the fan module of FIG. 22, including the fan impeller and the fan ring;

FIG. 24 shows a further cross-section of the fan module of FIG. 22 in a perspective view;

FIG. 25 shows a perspective view of a fan module of a further embodiment of the invention;

FIG. 26*a* shows a sectional view of a section of the fan module of FIG. 25, and FIG. 26*b* shows two sections of the fan module in a perspective view.

The accompanying drawings should convey further understanding of the embodiments of the invention. They illustrate embodiments of the invention and clarify the principles and concepts behind the invention in conjunction with the description. Other embodiments and many of the described advantages are apparent with respect to the drawings. The elements of the drawings are not necessarily illustrated true to scale in relation to each other.

In the figures in the drawing, the same elements, features and components, or those serving the same function and having the same effect, are provided with the same reference numerals in each case—unless otherwise specified.

DESCRIPTION OF EMBODIMENTS

Figures 1, 2, 3:
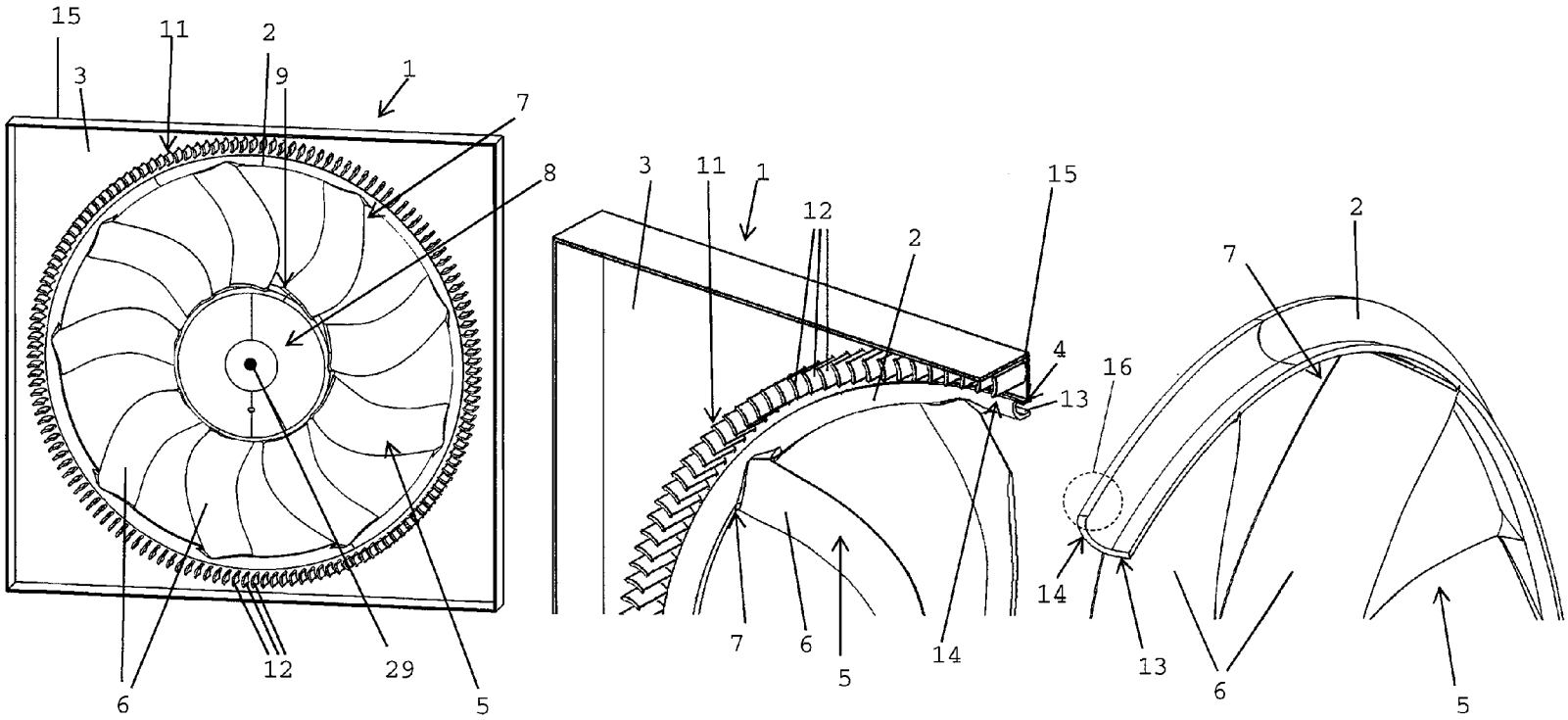
FIG. 1 shows a perspective front view of a fan module according to a first embodiment of the invention.
FIG. 2 shows a perspective view of a section of the fan module according to FIG. 1.
FIG. 3 shows a perspective view of a section of the fan ring of FIGS. 1 and 2.

FIG. 1 shows a perspective front view of a fan module 1, in particular a cooling fan module for a vehicle, according to a first embodiment of the invention. Further, FIG. 2 shows a perspective view of a section of the fan module 1 according to FIG. 1. Moreover, FIG. 3 shows a perspective view of a section of the fan ring 2 of FIGS. 1 and 2.

The cooling fan module 1 comprises a shroud or frame 3 provided with an opening 4 or orifice on which a fan or fan impeller 5 is located. In the following the term frame is used, but the term shroud can be used instead. The fan impeller 5 is fixed to a motor shaft, and the motor (not shown in FIG. 1) is located inside the fan hub 8 and fixed to the frame 3 by assembly means, e.g. struts etc., not shown in FIG. 1. The fan can rotate around the center line of the opening 4 perpendicular to the frame 3 by means of the motor shaft rotating inside the motor. The center point 29 of the opening of the frame 3 which lies of the center line is indicated in FIG. 1 and further in FIGS. 21 and 22 below.

Further, the fan impeller 5, in particular an axial fan impeller, comprises a plurality of fan impeller blades 6. The fan impeller blades 6 are attached at their lower end or inner end to a fan hub 8 and are further connected to one another at their upper end or outer end 7 via an outer fan ring 2. The fan ring 2 is located between the fan impeller 5 and the frame 3 as shown in FIGS. 1 and 2. An air gap 10 (shown in FIGS. 9 and 11) is provided between the fan ring 2 and frame 3, the recirculating airflow of the cooling fan module 1 flows through said air gap 10.

Further, the inventive fan module 1 comprises an additional recirculating flow guiding device 11 comprising a plurality of guide vanes 12 located on an upstream side or front side of the frame 3 surrounding the opening or orifice 4 for the fan impeller 5 as shown in the embodiment in FIGS. 1 and 2. In the embodiment as shown in FIGS. 1 and 2, the guide vanes 12 are curved and are further oriented or essentially oriented in the radial direction of the fan impeller 5. In FIG. 1 the guiding vane 12 is curved with leading edge aligned with incoming recirculating flow, but the overall orientation of the curved guide vane 12 is still in radial direction. Furthermore, in the embodiment as shown in FIGS. 1 and 2, the guide vanes 12 have for example the same length and are evenly arranged or evenly spaced around the opening 4 of the frame 3 and the circumference of the fan impeller 5. However, according to further embodiments of the invention, the length of the guide vanes 12 can be varied. In an embodiment of the inventive fan module between two longer guide vanes a shorter guide vane can be arranged (as shown in FIG. 20). However, the invention is not limited to this arrangement of guide vanes.

The guide vanes 12 shown in the embodiment in FIGS. 1 and 2 are curved. The guide vanes 12 can be at least partially curved or completely curved as it is the case in the embodiment shown in FIGS. 1 and 2. Furthermore, the guide vanes 12 can be also at least partially straight, flat or unbent as shown in subsequent FIGS. 25 and 26 or the guide vanes can be completely straight, flat or unbent as illustrated e.g. in subsequent FIG. 22. The provision of at least one guide vane 12 which comprises at least one portion which is curved and/or at least one portion which is straight applies to all embodiments of the inventive fan module 1. Furthermore, in the embodiment as shown in FIG. 1, the guide vanes 12 have the same length and are arranged to form a ring around the opening 4 of the frame 3 and the fan impeller 5. Further, the guide vanes 12 in FIG. 1 terminate before an outer edge 15 of the frame 3. In other embodiments as shown, e.g., in following FIG. 22, the guide vanes can also extend to the outer edge of the frame.

As shown in FIGS. 2 and 3, the fan ring 2 comprises a base section 13 and a lip section 14. The base section 13 extends, e.g., in an axial or essentially axial direction of the fan impeller 5. Further, the fan impeller blades 6 are attached with their upper end or outer end 7 to the base section 13 of the fan ring 2. The lip section 14 extends from the base section 13 upward or outward in direction to the outer edge of the frame 3. In the embodiment as shown in FIGS. 1, 2 and 3 the lip section 14 extends from the base section 13 upward in a radial direction or essentially radial direction of the fan impeller 5. According to the invention the leading end 16 of the lip section 14 is formed to direct recirculating airflow into the guide vanes 12.

According to the invention and as shown in FIGS. 1 to 3 the leading end 16 of the lip section 14 is turned in direction to the rear side or downstream side of the frame 3. This applies to all embodiment of the inventive fan module 1.

Figure 5:
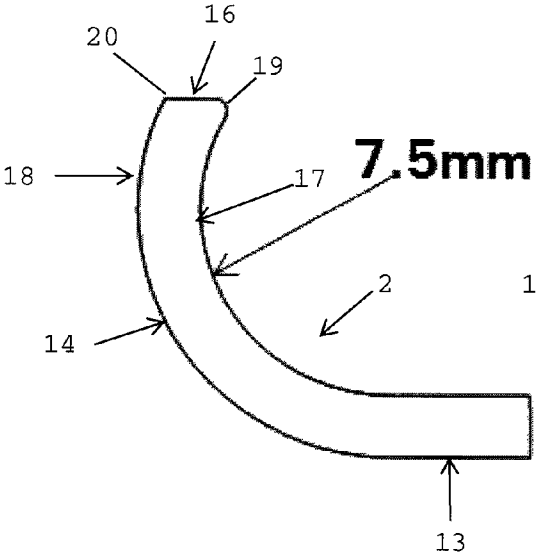
FIG. 5 shows a cross-section of a fan ring according to the first embodiment of the invention.

In the first embodiment as shown in FIGS. 1-3, the leading end 16 of the lip section 14 is curved outwards in direction to the rear side or downstream side of the frame 3 as shown in FIG. 5. In an alternative embodiment as shown in subsequent FIG. 6, the leading end of the lip section is turned by bending the leading end of the lip section, e.g., in the axial direction of the fan impeller in direction to the rear side or downstream side of the frame.

Figure 4:
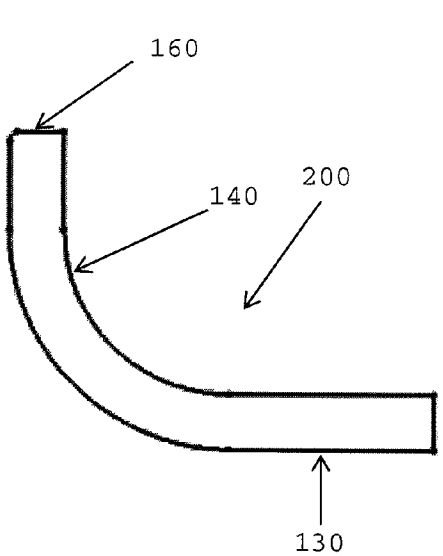
FIG. 4 shows a cross-section of a conventional fan ring.

In FIG. 4 a cross-section of a conventional fan ring 200 is shown. The fan ring 200 comprises a base section 130 and a lip section 140. The base section 140 extends in an axial direction of a fan impeller not shown. Further, the lip section 140 and its leading end 160 extend normally or straight to the base section 130. The leading end 160 of the lip section 140 is not further turned in direction to the rear side or downstream side of the corresponding frame.

In the embodiment of the invention as illustrated in FIG. 5, the fan ring 2 comprises a base section 13 and a lip section 14. The base section 13 extends in an axial direction of a fan impeller not shown. Further, as shown in FIG. 5 the leading end 16 of the lip section 14 is turned, in direction to the rear side or downstream side of the frame 3 and forms a radius. According to the embodiment illustrated in FIG. 5, a front side or downstream side 17 and a back side or upstream side 18 of the lip section 14 are both turned, e.g., curved, in direction to the rear side or downstream side of the frame 3. The front or downstream side 17 and the back side or upstream side 18 are two surfaces on both side of lip section 14 of fan ring 2, they can be e.g. curved surfaces.

Figure 7:
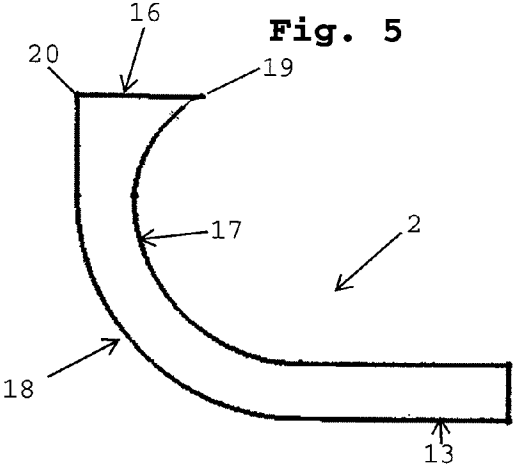
FIG. 7 shows a cross-section of a fan ring according to another embodiment of the invention.

The radius formed by the downstream side 17 of lip section 14 in the embodiment shown FIG. 5 is, e.g., 7.5 mm. However, the invention is not limited to a radius of 7.5 mm. The radius formed by the downstream side 17 of lip section 14 can be larger or smaller than 7.5 mm. In particular, the lip section 14 and its 2 side 17 and 18 can comprise any curvature or radius which is suitable to direct recirculating airflow into the guide vanes of the respective fan module. In the embodiment as shown in FIG. 5 a leading edge 19 of the leading end 16 is rounded. Further a trailing edge 20 of the leading end 16 forms, e.g., a blunt angle. The radius at the leading edge 19 is really small, e.g. 0.5 mm, it can be sharp, too, as shown in FIG. 7. The purpose of this small radius is to reduce stress concentration and further to reduce the possibility of cut of hand when worker handling it. Moreover, this small radius reduce noise in certain airflow condition, when at very low airflow rate, recirculating flow will "hug" fan ring 2 all the way from downstream side to upstream side. This small curvature at the leading edge 19 will prevent flow separation at the leading edge 19 and reduce noise.

Figure 6:
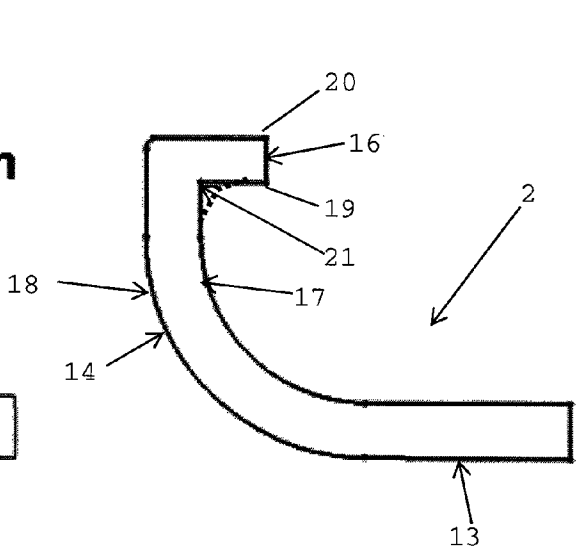
FIG. 6 shows a cross-section of a fan ring according to a further embodiment of the invention.

In FIG. 6 a further cross-section of an example of a fan ring 2 according to the invention is shown. The fan ring 2 comprises a base section 13 and a lip section 14. The base section 13 extends in an axial direction of a fan impeller not shown. Further, the lip section 14 extends for example normally or perpendicular to the base section 13.

In the example shown in FIG. 6 and as described before, the leading end 16 of the lip section 14 is turned by bending the leading end 16 of the lip section 14, e.g., in direction to the rear side or downstream side of the frame 3. In this connection the leading end 16 of the lip section 14 can be bent, e.g., in the axial or substantially axial direction of the fan impeller 5 in direction to the rear side of the frame. Furthermore, as shown in FIG. 6 the lip section 14 can be turned or bent such that the inner part or lower part of the lip section remains normally or straight to the base section 13 while the outer part or upper part of the lip section 14 extends in direction to the rear side of the frame and, e.g., parallel or essentially parallel to the base section 13.

Furthermore, the leading end 16 of the lip section 14 can be bent or folded to form a sharp edge 21 as shown exemplary in FIG. 6 or to form a rounded edge, as illustrated by the dotted line in FIG. 6. Further, in the embodiment as illustrated in FIG. 6 a leading edge 19 and a trailing edge 20 each form a sharp edge. However, the leading edge 19 and/or the trailing edge 20 can be also rounded instead of form a sharp edge. This applies to all embodiments of the invention.

In FIG. 7 another example of a fan ring 2 according to the invention is shown. The fan ring 2 comprises a base section 13 and a lip section 14. The base section 13 extends, e.g., in an axial or essentially axial direction of a fan impeller not shown. Further, the lip section 14 extends for example normally or perpendicular to the base section 13, and the downstream side 17 of the leading end 16 shown in the embodiment in FIG. 7 is turned in direction to the rear side or downstream side of the frame while the upstream side 18 of the leading end 16 extends normally or straight to the base section 13. Moreover, in the embodiment as illustrated in FIG. 7 a leading edge 19 and a trailing edge 20 of the leading end 16 each form a sharp edge. However, at least one of the leading edge 19 or the trailing edge 20 can be rounded. This applies to all embodiments of the invention.

Figure 8:
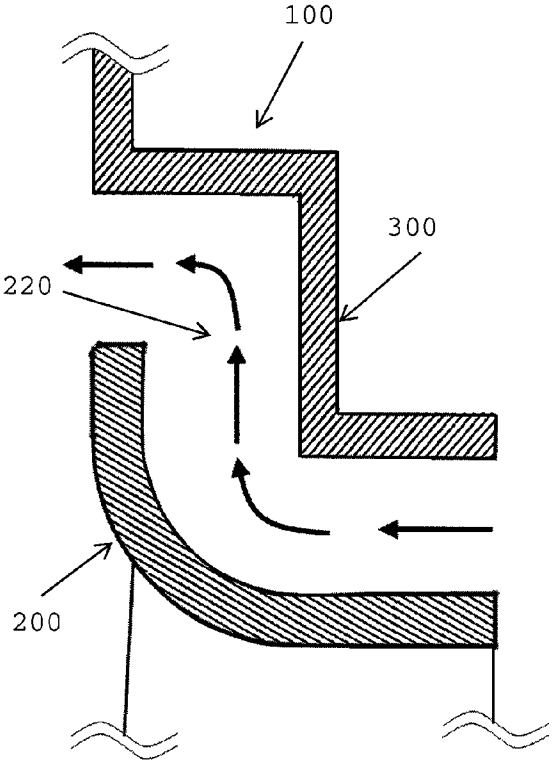
FIG. 8 shows a cross-section of a section of a conventional fan module.

In FIG. 8 a cross-section of a section of a conventional fan module 100 and in FIG. 9*a* a cross-section of a section of an inventive fan module 1 are shown. FIG. 9*b* shows a cross-section corresponding to the fan module in FIG. 9*a*, wherein the guide vane 12 in FIG. 9*b* is short. In particular, FIGS. 8 and 9*a*, 9*b* each illustrate a recirculating airflow passage formed by the fan ring 2, 200 and the frame 3, 300 of the fan module. In this connection, the inventive fan module 1 as shown in FIG. 9*a* is further provided with an additional recirculating flow guiding device 11 comprising a plurality of guide vanes 12 located on an upstream side or front side of the frame 3. In FIG. 9*a* an exemplary guide vane 12 is shown by a dashed line. Furthermore, in FIGS. 8 and 9*a, b*, velocity vectors illustrate airflow through the recirculation passage.

As can be derived from a comparison of the conventional fan module 100 and the inventive fan module 1, the frame 3 of the inventive fan module 1 is configured so that after recirculating airflow passing through the gap between fan ring 2 and the opening 4 of the frame 3, it can go straight outwards radially without been severely blocked or forced to turn axial immediately as in a conventional fan module. In FIG. 8, the frame 300 extends above or covers an exit 220 of the recirculating airflow passage and thus forces the airflow after passing the exit to turn axially. In contrast, the frame 3 of the embodiment of the inventive fan module 1 as shown in FIG. 9*a* is formed not to interfere with the exit 22 or blocks the exit 22 of the recirculating airflow passage. Furthermore, since the height of the guide vanes 12 in FIG. 9*a* is high enough so that the guide vanes 12 extend beyond the upstream side of the fan ring 2, recirculating flow goes through the guide vanes and swirl motion is removed. In case the height of the guide vanes 12 is too short as illustrated in FIG. 9*b*, so that the height of the guide vanes is not high enough and the guide vanes terminate before the leading end of the lip portion, a portion of recirculating flow may bypass the guide vanes 12 and keeps its swirl motion.

In FIG. 10 a perspective view of a section of a conventional fan module 100 is shown, comprising a fan ring 200 and a frame 300 as shown before in FIG. 8. The airflow is illustrated in FIG. 10 by velocity vectors. The velocity vectors show the recirculation flow carrying swirl motion. As described before, pressure after or downstream the fan impeller is higher than pressure in front or upstream of the fan impeller. This pressure difference drives airflow from downstream of the fan impeller back to upstream of it forming recirculation flow. Due to the rotation of the fan impeller, there is a swirling motion in downstream of the fan impeller. This swirl motion is also carried to the front or upstream of the fan impeller by this recirculation flow. As a result, at tip region of the fan impeller blade, encircled with a dashed line in FIG. 10, see a drastic relative tangential velocity change, which results in airflow separation at blade tip region and the fan module is significantly less efficient and generates more noise. The rotating direction of the fan is indicated with an arrow in FIG. 10.

In contrast thereto, FIGS. 11 and 12 show perspective views of sections of the fan module according to the first embodiment of the invention, as shown before in FIGS. 1, 2, 3, 5 and 9. In FIGS. 11 and 12 the airflow is also illustrated by velocity vectors. Further, the rotating direction of the fan is indicated with an arrow in FIG. 12.

The fan impeller 5 as shown in FIGS. 11 and 12 comprises fan impeller blades 6 which are attached to the fan hub 8 and are further connected to one another via the outer fan ring 2. As illustrated in FIGS. 11 and 12, the fan ring 2 is located between the fan impeller 5 and the frame 3, wherein the air gap 10 is provided between the fan ring 2 and frame 3. The recirculating flow guiding device 11 comprising guide vanes 12 is located on the upstream side or front side of the frame 3 surrounding the opening 4 of the fan impeller 5. In the embodiment as shown in FIGS. 11 and 12, the guide vanes 12 are, e.g., curved and are further oriented or essentially oriented in the radial direction of the fan impeller 5. Moreover, in the embodiment as shown in FIGS. 11 and 12, the guide vanes 12 have, e.g., the same length and are for example evenly arranged or evenly spaced around the opening of the frame 3 and the circumference of the fan impeller 5. In FIG. 11 further the upstream side 28 and the downstream side 30 of the fan ring 2 are indicated which correspond to the upstream side or front side and to the downstream side or rear side of the frame 3, respectively.

As shown in FIG. 11 by the velocity vectors, the lip section 14 of the fan ring 2 which is turned, e.g. curved, in direction to the rear side or downstream side of the frame 3 directs recirculation flow into the guide vanes 12 of the recirculating flow guiding device 11. Further, as illustrated in FIG. 12 by the velocity vectors, the swirl motion of the recirculation flow is removed by the guide vanes 12.

Due to the pressure difference, recirculation flow comes into the air gap 10 between fan ring 2 and the frame 3 from the rear side or downstream side of the fan impeller 5, and carries swirl motion with it. The lip section 14 of the fan ring 2 forces this airflow to make a sudden turn and directs this recirculation flow into the guide vanes 12 as illustrated by the velocity vectors in FIG. 11. When the airflow goes through the guide vanes 12 and out radially away from the fan impeller 5, swirling motion is removed and the airflow goes back into the fan impeller 5 again with the same tangential relative velocity to the fan impeller 5 as the normal incoming airflow.

The tip region 23 of the fan impeller blade 6, encircled with a dashed line in FIG. 12, has the maximum velocity of the fan blade because it is at the largest radius of the fan. Therefore, the tip region 23 is most important section of the fan impeller 5. The specially designed fan ring to frame configuration of this invention directs recirculating airflow to go through the guide vanes 12, wherein swirl is removed from the airflow. Because recirculation flow primarily influences the tip region 23, the inventive fan module 1 drastically improves working condition in the tip region 23 and makes the direction of incoming airflow in this region much more stable and consistent with the rest of the fan impeller blade 6. As a result, flow separation in this region is eliminated, fan pressure rise and fan efficiency increase significantly.

In FIG. 13 a diagram is shown, illustrating the fan performance curve of a conventional cooling fan module as shown exemplary, e.g. in FIGS. 8 and 10 before and the fan performance curve of a cooling fan module according to the invention as shown exemplary, e.g. in FIGS. 9, 11 and 12 before.

Both, the conventional fan module and the cooling fan module of the invention in FIG. 13 and subsequent FIG. 14, comprise the same fan impeller blades 6 and the same fan ring to frame clearance of, e.g., 6 mm. However, the inventive fan module comprises in contrast to the conventional fan module a recirculating flow guiding device comprising a plurality of guide vanes as shown, e.g., in FIGS. 9, 11 and 12, and a fan ring with a lip portion which is turned in direction to the rear side of the frame of the fan module to direct a recirculating airflow into the guide vanes. According to FIG. 13 the fan pressure rise DP is shown depending on the volume flow rate Q. DP means "Difference in Pressure" before and after the fan. It shows the ability of a fan module in pumping airflow from upstream to downstream (against pressure gradient).

In the diagram the solid line indicates the fan performance of the conventional fan and the dashed line the fan performance of the fan module according to the invention. From the diagram it can be derived, that the inventive fan module provides a better fan performance than the conventional fan, since a higher fan pressure rise DP can be achieved at the same volume flow rate Q.

Further, in FIG. 14 a diagram is shown, illustrating a fan efficiency curve of the conventional cooling fan module and that of the inventive cooling fan module of FIG. 13.

According to FIG. 14 the fan efficiency is shown changing with the volume flow rate Q.

In the diagram the solid line indicates the fan efficiency of the conventional fan and the dashed line the fan efficiency of the fan module according to the invention. It can be derived from the diagram as shown in FIG. 14, that the inventive fan module provides significantly better fan efficiency at the same volume flow Q than the conventional fan over most of the fan operating range.

In FIG. 15 a perspective view of a section of the fan module 1 according to, e.g., FIGS. 11 and 12 is shown. Further, FIG. 16 shows a cross-section of the fan module 1 of FIG. 15 in a perspective view.

Each guide vane 12 in the embodiment as shown in FIGS. 15 and 16 and before in FIGS. 11 and 12 is curved, e.g., completely curved along its length. A leading end or leading edge 27 of guide vanes 12 aligns with incoming recirculating airflow to reduce flow separation near the vanes as will be further explained with respect to FIGS. 17, 18 and 19 below.

Further, each guide vane 12 is basically an extruded 2D profile and its cross-section profile is located in the r-O plane of cylindrical coordinate system based on the fan impeller axis, the orientation of the cross-section profile is largely in r direction, and guide vanes 12 are extruded largely in z direction.

To avoid blocking airflow, the guide vanes 12 are preferably thin and the spacing between neighboring guide vanes 12 is preferably far enough. The thickness of the guide vanes 12 is preferably between 1 mm to 3 mm, and the angular spacing between neighboring guide vanes 12 is preferably between 1° degree to 5° degree. If the angle is too large, there will be a large space in between the neighboring guide vanes 12 and airflow will not follow the curvature of the guide vanes 12 to turn anymore.

As shown in FIG. 15, the angular degree between neighboring guide vanes 12 is for example 1.25 degree. In following FIG. 21 the angular degree between neighboring guide vanes is, e.g., 4° degree.

The guide vanes 12 can be unequally spaced to minimize possible tonal noise. Alternatively the guide vanes 12 can be equally spaced as shown in FIGS. 15 and 16.

The clearance between the guide vanes 12 and the fan ring 2 is preferably as tight as possible to reduce the overall recirculating flow rate, and reduce airflow bypass of guide vanes 12. Further, the clearance is varying with the size of the fan impeller 5 and is for a 400 mm to 500 mm diameter fan impeller 5 used in the design implementation shown in FIG. 16, e.g., preferably 4 mm to 6 mm in radial direction and 5 mm to 7 mm in axial direction. As shown in FIG. 16 for the 485 mm diameter fan impeller 5 the clearance is, e.g., 6 mm in radial direction and 6 mm in axial direction.

The guide vanes 12 also are preferably high enough to extend beyond the upstream side 28 of the fan ring 2 to reduce airflow bypass these guide vanes. In FIG. 16, the guide vanes 12 have a height so that the guide vanes 12 extend preferably in a range of 0 mm to 20 mm, e.g., 10 mm as shown in FIG. 16, beyond the leading edge 20 of the guide vanes 12 on the upstream side 28 of the fan ring 2.

In case of 0 mm, the guide vanes 12 terminate at the upstream side 28 of the fan ring 2 as indicated by a dotted line in FIG. 16. In other words, the guide vanes 12 extend 0 mm beyond the upstream side 28 of the fan ring.

In case the height of the guide vanes 12 is too high so that the guide vanes 12 extend too far beyond the upstream side 28 of the fan ring 2, the guide vanes 12 may collide with a radiator in front of the fan. On the other hand, if the height if the guide vanes 12 is too short, so that the guide vanes 12 terminate before the leading edge 19 a portion of recirculating airflow will bypass vanes 12 and swirl motion cannot be removed effectively as shown in FIG. 9*b*.

In FIGS. 17 and 18 a schematic view of a guide vane 12 of the invention is shown. The corresponding neighboring guide vane is not illustrated. The airflow is further illustrated by velocity vectors. As can be derived from FIGS. 17 and 18, the leading edge 27 of each guide vane 12 is aligned with the incoming recirculating airflow. After the incoming recirculating airflow went through the guide vanes 12 all swirl component is removed as shown in FIGS. 17 and 18 without flow separation.

In contrast in FIG. 19 a schematic view of a guide vane 12 is shown, wherein the leading edge 27 of the guide vanes 12 is not aligned with the incoming recirculating airflow. The corresponding neighboring guide vane is not illustrated in FIG. 19. Since the leading edge 27 of the guide vanes 12 is not aligned with the incoming airflow, the airflow is separated in between the guide vanes 12 as shown by the velocity vectors illustrating the airflow. This results in efficiency loss and increased noise.

In FIG. 20 a perspective view of a section of an alternative of the fan module 1 according to FIG. 15 is shown. In this alternative, instead of guide vanes having the same length as it is the case in the embodiment shown in FIG. 15, longer and shorter guide vanes 12 can be arranged alternately as shown exemplary in FIG. 20. Different lengths of the guide vanes 12 in FIG. 20 are due to distance between A and B is too small to fit in a full guide vane in between in the molding tooling as shown in FIG. 20. When radius increases, distance between guide vanes 12 also increases and a partial guide vane 12 or shorter guide vane 12 can be fit in between the two long or longer guide vanes 12. Further, the more guiding vanes 12 the better, as airflow will be less likely to separate and better follows curvature of the guide vanes 12. However, the long and short guide vanes 12 in FIG. 20 can be also at least partially straight or completely straight instead of curved as shown in following FIGS. 21 to 26.

In FIGS. 21 and 22 perspective views of a fan module 1 according to a further embodiment of the invention are shown. In this connection, FIG. 21 shows a perspective view of a section of the fan module 1. In contrast to the embodiment as shown, e.g., in FIG. 1, the embodiment as shown in FIGS. 21 and 22 comprises straight, e.g., completely straight or flat guide vanes 12 and further a fan ring 2 with a configuration as shown before, e.g., in FIG. 7 and in following FIGS. 22 to 24.

FIGS. 23 and 24 show cross-sections of the fan module 1 of FIG. 22 in a perspective view.

Each guide vane 12 in the embodiment as shown in FIGS. 21 to 24 is, e.g., straight or flat and arranged on the upstream side or front side of the frame 3. Further, each guide vane 12 is located in the radial direction or in the θ=constant plane of cylindrical coordinate system based on the fan impeller axis.

To avoid blocking airflow, the guide vanes 12 are preferably thin and the spacing between neighboring guide vanes 12 is preferably far enough. The thickness of the guide vanes 12 is in a range of, e.g., 1 mm to 3 mm, and the angular spacing between neighboring guide vanes is preferably an angular range between 1° degree to 5° degree, e.g., 4° degrees as shown in FIG. 21. In FIGS. 21 and 22 the center point 29 of the opening 4 of the frame 3 is indicated.

Further, an upper portion or outer portion 31 of the guide vanes 12 extends beyond the upstream side 28 of the fan ring 2 while lower portion or inner portion 32 of the guide vanes 12 is arranged in the gap between the frame 3 and the fan ring 2 and further terminates before the base section 13 of the fan ring 2 as shown in FIGS. 23 and 24.

Furthermore, some or all of the guide vanes 12 can be unequally spaced to minimize possible tonal noise. Alternatively some or all of the guide vanes 12 can be equally spaced as shown, e.g., in FIGS. 21 to 24. Further, as pointed out before, the guide vanes 12 can have the same length or can be varied in length. In an embodiment of the inventive fan module longer and shorter guide vanes can be arranged alternately depending on packaging constrain, as shown before in the example in FIG. 20.

In FIGS. 25 and 26*a*, 26*b* a further embodiment of the inventive fan module 1 is shown. FIG. 25 shows a perspective view of the fan module 1 and FIG. 26*a* shows a sectional view of a section of the fan module 1 of FIG. 25. Further FIG. 26*b* shows two sections of the fan module in a perspective view.

The embodiment of the fan module 1 shown in FIGS. 25 and 26*a*, 26*b* is essentially identical with the embodiment shown and described with respect to FIGS. 1-3 and 5. The description thereof will be therefore not repeated. However, the fan module 1 shown in FIGS. 25 and 26*a*, 26*b* differs from the fan module of FIGS. 1-3 and 5 in that the frame 3 is not rectangular, e.g. square, but comprises for example curved areas 26 to receive a larger fan impeller 5. Furthermore, the guide vanes 12 of the recirculating flow guiding device 11 of the embodiment illustrated in FIGS. 25 and 26*a*, 26*b* vary in length and each guide vane 12 comprises a curved portion 24 and a straight or flat portion 25 in contrast to the completely curved guide vanes shown in FIGS. 1 and 2. In FIG. 26*a*, the upstream side 28 of the fan ring 2 is indicated.

In the embodiment as illustrated in FIGS. 25 and 26*a*, 26*b* the length of the guide vanes 12 is adapted according to the form or contour of the frame 3, wherein the length of the guide vanes 12 is shorter in the curved areas 26 of the frame 3 to allow to mount a fan impeller 5 in an opening 4 of the frame 3 and to surround the complete circumference of the fan impeller 5 with guide vanes 12. Due to packaging constrain, it is possible to only partially surround fan impeller 5 with guide vanes 12 in circumferential direction on upstream side of frame 3 to take partial advantage of this invention. Further, as can be derived from FIGS. 25 and 26*a*, 26*b* the curved portion 24 of the guide vane 12 is arranged adjacent to the fan ring 2. Furthermore, the curved portion 24 of each guide vane 12 is identical and its leading edge 27 aligns with incoming recirculating airflow. As guide vanes start at different radial location, the longer but narrower guide vanes are arranged in a staggered manner to shorter but wider guide vanes to ensure their leading edge always align with incoming recirculating flow as shown in FIG. 26*b*.

Although the present invention has been fully described above by means of preferred embodiments, it is not limited to the above, but may be modified in a number of ways.

According to the invention as described before with respect to the figures a set of guide vanes largely oriented in the radial direction is created on the upstream side of the frame surrounding frame opening as shown, e.g., in FIGS. 1 and 2 before. When the reverse or recirculating flow goes through the guide vanes, the swirl motion is removed and fan performance is improved. On the fan ring side, a lip portion is added to the larger radius leading edge side of the fan ring, as shown e.g. in FIG. 3 before, to effectively direct recirculating flow into these guide vanes. The concept of this invention can also be applied outside of motor vehicle to any configuration of shroud/fan with ring in particular in the automotive field.

LIST OF REFERENCE NUMERALS

1 fan module
2 fan ring
3 frame
4 opening
5 fan impeller
6 fan impeller blades
7 outer end (fan impeller blades)
8 fan hub
9 inner end (fan impeller blades)
10 air gap
11 recirculating flow guiding device
12 guide vane
13 base section (fan ring)
14 lip section (fan ring)
15 outer edge (frame)
16 leading end (fan ring)
17 downstream side (lip section)
18 upstream side (lip section)
19 leading edge (leading end)
20 trailing edge (leading end)
21 sharp edge (lip section)
22 exit
23 tip region
24 curved portion (guide vane)
25 flat portion (guide vane)
26 curved area (frame)
27 leading edge of guide vanes
28 upstream side of fan ring
29 centre point of frame opening
30 downstream side of fang ring
31 outer portion of guide vane
32 inner portion of guide vane
100 fan module
130 base section
140 lip section
160 leading end
200 fan ring
220 exit
300 frame

The invention claimed is:

1. Cooling fan module, in particular for a motor vehicle, comprising:

a frame, wherein the frame is provided with an opening;

a fan impeller located in the opening of the frame, wherein the fan impeller comprises a plurality of fan impeller blades, wherein the fan impeller blades are connected to one another at an outer end via an outer fan ring, wherein the fan ring comprises a base portion and a lip portion, wherein the fan impeller blades are connected to the base portion, wherein the lip portion extends from the base portion radially outward, and wherein a leading end of the lip portion is turned in direction to the downstream side of the frame;

a recirculating flow guiding device including a plurality of guide vanes located on the upstream side of the frame and around the opening of the frame;

wherein an air gap is provided between the fan ring and the frame, a recirculating flow from downstream side of the cooling fan module flowing through said air gap, and is turned by the leading end of the lip portion into the recirculating flow guiding device to remove swirl motion from the recirculating flow, wherein the plurality of guide vanes are located on the upstream side of the frame outside of the fan impeller and are radially displaced from the air gap relative to the fan impeller, or an upper portion of each of the plurality of guide vanes is located on the upstream side of the frame outside of the fan impeller and is radially displaced from the air gap relative to the fan impeller.

2. Cooling fan module according to claim 1, wherein at least a downstream side of the lip section is turned in direction to the downstream side of the frame, wherein an upstream side of the lip section is also turned in direction to the downstream side of the frame or extends at least partially straight to the base section of the fan ring.

3. Cooling fan module according to claim 2, wherein at least one of a leading edge or a trailing edge of the leading end is rounded or forms a sharp edge.

4. Cooling fan module according to claim 1, wherein the leading end of the lip section is curved or folded to turn the leading end in direction to the downstream side of the frame, wherein, when the leading end is folded, the leading end forms a sharp folding edge or a rounded folding edge.

5. Cooling fan module according to claim 1, wherein the recirculating flow guiding device is located between the frame and the fan impeller on the upstream side of the frame and the leading end of the lip portion is turned in direction of outwards radially and towards the downstream side of the frame.

6. Cooling fan module according to claim 1, wherein the recirculating flow guiding device comprises guide vanes which are arranged around the opening of the frame and the circumference of the fan impeller and wherein the guide vanes are oriented preferably in the radial direction of the fan impeller.

7. Cooling fan module according to claim 6, wherein at least two of the guide vanes comprise the same length or are different in length.

8. Cooling fan module according to claim 6, wherein at least two of the guide vanes comprise at least one curved portion and/or at least one flat portion, wherein the curved portion of guide vanes is preferably aligned with incoming recirculating airflow to avoid separation.

9. Cooling fan module according to claim 6, wherein at least two of the guide vanes extend to an outer edge of the frame or terminate at the outer edge of the frame.

10. Cooling fan module according to claim 6, wherein at least an outer portion of at least one of the guide vanes comprises a height, so that the outer portion of the guide vane extends beyond the upstream side of the fan ring, terminates at the upstream side of the fan ring or terminates before the lip section of the fan ring.

11. Cooling fan module according to claim 6, wherein the guides vanes are equally and/or unequally spaced around the circumference of the fan impeller, wherein the angular spacing between at least two neighbouring guide vanes is preferably in a range between 1° degree to 5° degree.

12. Cooling fan module according to claim 6, wherein a clearance in a radial direction relative to the fan impeller between the guide vanes and the fan ring is in a range of 4 mm to 6 mm, and a clearance in an axial direction relative to the fan impeller is in a range of 5 mm to 7 mm.

13. Cooling fan module according to claim 12, wherein for a 400 mm to 500 mm diameter fan impeller the clearance is in a range between 4 to 6 mm in radial direction and in a range between 5 mm to 7 mm in axial direction of the fan impeller.

14. Cooling fan module according to claim 6, wherein the thickness of at least one guide vane is in a range of 1 mm to 3 mm.

15. Cooling fan module according to claim 1, wherein the frame is configured so that an airflow passing through an exit of an airflow passage formed by the air gap can go straight or essentially straight outwards radially without been blocked by the frame.

16. Cooling fan module according to claim 1, wherein the upper portion of the guide vanes extends beyond an upstream side of the fan ring, while a lower portion of the guide vanes is arranged in the air gap between the frame and the fan ring and terminates before the base section of the fan ring.

17. System comprising a cooling fan module according to claim 1 and a heat exchanger, wherein the heat exchanger is arranged on the upstream side and/or the downstream side of the fan module.

* * * * *